United States Patent [19]

Justus

[11] 4,340,623

[45] Jul. 20, 1982

[54] HIGH SPEED SIZE PRESS

[75] Inventor: Edgar J. Justus, Beloit, Wis.

[73] Assignee: Beloit Corporation, Beloit, Wis.

[21] Appl. No.: 214,138

[22] Filed: Dec. 8, 1980

[51] Int. Cl.[3] ..... B05D 3/12; B05C 3/02; B05C 11/02; B05C 3/12

[52] U.S. Cl. ..... 427/361; 118/122; 118/404; 118/405; 118/414; 162/265; 427/358; 427/365; 427/356; 118/115

[58] Field of Search ..... 118/122, 404, 405, 414; 427/356, 358, 365; 162/265

[56] References Cited

U.S. PATENT DOCUMENTS 3,575,134 4/1971 Quint ..... 118/122
4,192,712 3/1980 Dreher ..... 118/405 X

FOREIGN PATENT DOCUMENTS 28136 4/1964 German Democratic Rep. ..... 118/405

*Primary Examiner*—Michael R. Lusignan
*Attorney, Agent, or Firm*—Hill, Van Santen, Steadman, Chiara & Simpson

[57] ABSTRACT

A method and apparatus for high speed application of sizing compositions in which there is a pair of oppositely rotating rolls forming a coating nip therebetween through which a paper web to be sized is directed. Sizing composition is delivered to the nip in sufficient quantity to form a pond of sizing composition above the nip. The invention is particularly concerned with reducing the effects of translational energy which is transmitted into the pond from the rolls by providing at least one flexible baffle member which extends into the pond on opposite sides of the paper web into proximity with the nip. The baffle member should be sufficiently long to absorb translational energy which would otherwise be absorbed by the pond of sizing material.

10 Claims, 3 Drawing Figures

FIG. 1
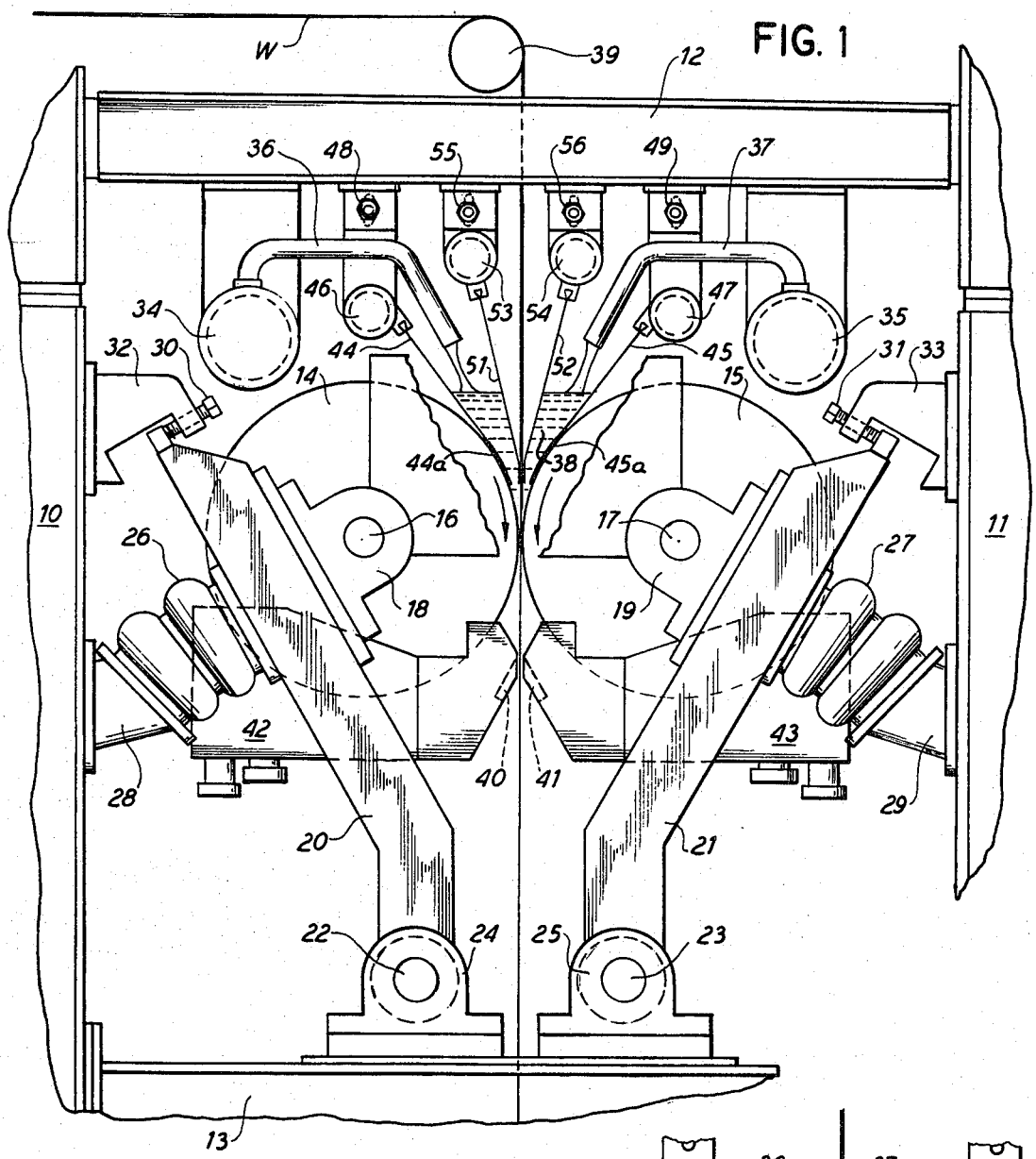
FIG 2
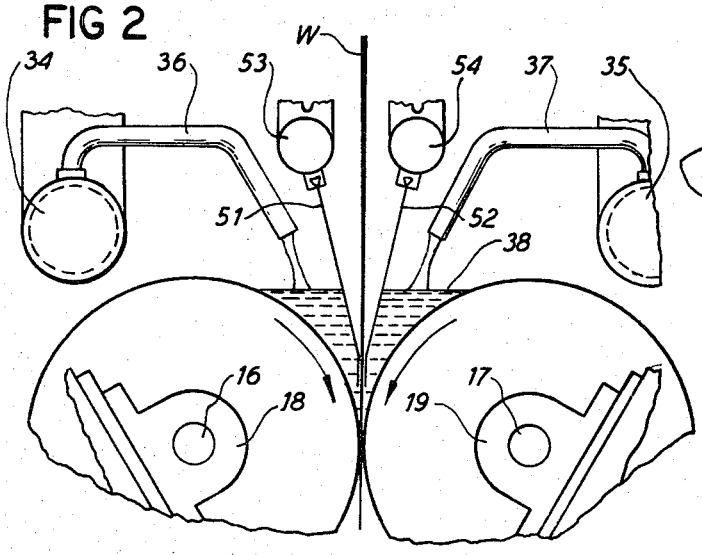
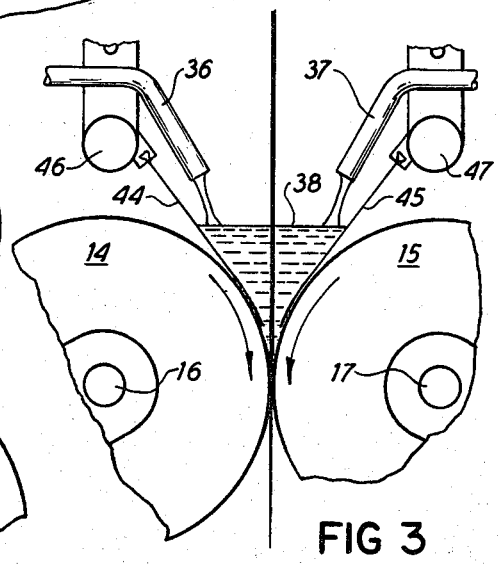
FIG 3

HIGH SPEED SIZE PRESS

BACKGROUND OF THE INVENTION

1. Field of the Invention

The present invention is in the field of a method and apparatus for reducing the agitation of sizing liquid caused by energy being delivered into the pond by the high speed surfaces of the rolls and paper. Specifically, the sizing pond is isolated from the high speed surfaces by one or more sets of baffles which are positioned between the traveling web and the rotating roll.

2. Description of the Prior Art

In a typical sizing operation, a pond of the sizing material which usually consists of an aqueous latex of relatively high viscosity is provided at the nip of a pair of coacting, oppositely rotating rolls. The paper web is directed through the coating nip for simultaneous application of the sizing material on both surfaces. Experience in operating such size applicators shows that at high speed the pond of sizing liquid between the paper and the rolls of the size press becomes so agitated that the material is actually thrown from the pond. The kinetic energy of the moving surfaces induces rapid circulation of the coating. Both roll surfaces and the paper are moving toward the nip, pulling the size composition with them. This size solution must then return or circulate and when the upward velocity of the size liquid away from the moving surfaces becomes sufficiently high, the coating will break through the surface tension of the pond and will cause splashing.

SUMMARY OF THE INVENTION

The present invention provides a size press assembly and a method for operating the same wherein the sizing composition is delivered to the coating nip between a pair of oppositely rotating rolls to form a pond of material above the nip, as in conventional practice. Translation of high intensity energy from the rapidly rotating rolls and rapidly moving paper into the sizing composition is reduced to a large extent by providing at least one flexible baffle member extending into the sizing material pond on opposite sides of the paper web into proximity with the nip. The baffle members prevent excessive circulation of liquid within the pond on either side of the web, so there is less velocity of the coating toward the pond surface. The baffle members are sufficiently long to shield the pond from translational energy from the roll surfaces.

The present invention can take several forms. In one such form, a baffle member is positioned on each side of the web in slightly spaced relation to a portion of the periphery of one of the rolls, and terminates short of the nip. In another form of the invention, each baffle member on opposite sides of the traveling web is partly immersed in depending relation in the pond in spaced relation to the roll on each side, the lower end of each baffle member terminating short of the nip and being in spaced parallel relation with the web as it approaches the nip.

A third and preferred form of the invention consists in a combination of the two previously described embodiments, namely, a pair of baffles which have terminal portions in spaced relation to a portion of each roll, and a second pair of baffle elements which are spaced from the rolls and which terminate in end portions which run parallel to the traveling paper web a slight distance above the coating nip.

BRIEF DESCRIPTION OF THE DRAWINGS

A further description of the present invention will be made in conjunction with the attached sheet of drawings in which:

FIG. 1 is a view in elevation of a preferred form of the invention;

FIG. 2 is a fragmentary view in elevation illustrating a modified form of the present invention; and FIG. 3 is a fragmentary view in elevation of a still further modified form of the invention.

DESCRIPTION OF THE PREFERRED EMBODIMENTS

In FIG. 1, there is shown a size press assembly embodying the improvements of the present invention, the press assembly being confined within a pair of vertical frame members 10 and 11 which are joined by horizontal crossbars 12 and 13.

A pair of oppositely rotating rolls 14 and 15 are mounted for rotation on shafts 16 and 17, respectively. The ends of the shafts 16 and 17 are received in bearing housings 18 and 19 which are fixedly secured to pivotal angular support arms 20 and 21, respectively. The lower ends of these arms 20 and 21 are capable of pivoting around pivot shafts 22 and 23, respectively. These shafts, in turn, are supported in bearing structures 24 and 25 which are fixedly secured to the lower horizontal crossbar 13. The nip pressure between the rolls can be adjusted by providing a double diaphragm or bellows 26 and 27 in conjunction with each roll, the bellows being bottomed against a support 28,29 which is fixedly secured to the vertical frame members 10 or 11. The introduction of fluid pressure into the bellows 26 or 27 serves to adjust the pressure at the coating nip existing between the two rolls. Pivotal movement of the two roll assemblies is limited by the provision of an adjustable stop bolt 30, 31 which is received within a support bracket 32,33 fixedly secured to the vertical frame members 10,11.

The size composition is delivered to the coating nip by means of a pair of headers 34 and 35 which are positioned in depending relation from the upper crossbar 12. One or more nozzles 36, 37 deliver the relatively viscous sizing composition to the area of the nip, where it forms a pond 38 immediately above the coating nip. The size composition is applied to a moving paper web W which is directed into the nip over a guide roll 39 in the usual manner. Excess coating material is removed and the coating is smoothed by the provision of a pair of doctor blades 40 and 41 on opposite sides of the web W as shown in FIG. 1. The rotating rolls 14 and 15 are positioned above a pair of troughs 42 and 43 which collect any excess sizing material carried along on the peripheries of the rolls 14 and 15.

With high speed roll rotation, and high speed movement of the web, the pond 38 tends to absorb kinetic energy from the moving web and the rolls and establishes a circulating flow pattern in the pond. Since both roll surfaces and the paper are moving toward the nip, pulling sizing solution with them, the upward velocity eventually becomes high enough to cause the coating to break the surface and splash.

The high energy resulting from high speed operation must be prevented from affecting the pond and in the form of the invention shown in FIG. 1, this is accomplished by providing a plurality of baffle elements at various locations within the pond 38. FIG. 1 illustrates a pair of such baffle elements 44 and 45 being held in clamped relation within a pair of clamping members 46 and 47, respectively, and depending from the upper crossbar 12 by means of adjustment means 48 and 49 which permit the vertical level of the two baffle elements to be adjusted, as well as facilitating withdrawal of the baffles for cleaning or replacement. The baffle elements 44 and 45 may be composed of flexible material such as hard rubber or a synthetic resin such as a polycarbonate resin marketed under the trademark "Lexan". Each baffle element 44 and 45 preferably has an arcuate terminal end portion 44*a* and 45*a*, respectively, which position the end portion in slightly spaced relation with a portion of the periphery of the respective roll.

A second set of baffles 51 and 52 is also provided in the embodiment shown in FIG. 1. The baffle elements 51 and 52 are clamped within suitable clamping means 53 and 54 and similarly have vertical adjustment means 55 and 56 which can be used to adjust the positioning of the baffles 51 and 52 relative to the nip, and also serve to permit easy removal of the baffle elements. In the case of baffle elements 51 and 52, their terminal end portions are relatively flat so as to be in substantially parallel spaced relation with the traveling web W near the coating nip.

The embodiment shown in FIG. 2 uses only baffles 51 and 52 to protect the pond 38 from the roll surfaces. In the embodiment shown in FIG. 3, only the baffles 44 and 45 are employed. The embodiments of FIGS. 2 and 3 can be used where the energy to be shielded from the pond is not severe whereas that form of the invention shown in FIG. 1 is suitable for conditions of very high instability in the sizing liquid.

In any of the forms shown in the present invention, the sizing pond is isolated from the high speed surfaces of the rolls and the paper such that the rolls and paper cannot transfer a great deal of energy into the pond. As less energy is induced in the sizing composition, the circulating velocities are reduced and the size liquid does not have a tendency to jump out of the pond. Experimental tests have been made indicating that the stationary baffles are very effective in stabilizing the sizing liquid pond. Through the use of two "Lexan" sheets contacting the roll surfaces, there was obtained a pond surface at 3,000 feet per minute which was more stable than occurred at 1,500 feet per minute without the stabilizing baffle sheets.

It will be observed that the baffle members of the present invention shield the sizing pond from the energy inducing high speed surfaces affecting the sizing puddle so that higher machine speeds can be used.

It will be understood that various modifications can be made to the described embodiments without departing from the scope of the present invention.

I claim as my invention:

1. A size press assembly comprising:

a pair of oppositely rotating rolls forming a coating nip therebetween, means for directing a paper web through said nip, means for delivering a sizing composition to said nip in sufficient quantity to form a pond of sizing composition above said nip, and at least one flexible baffle member extending into said pond on opposite sides of said paper web into proximity with said nip, each baffle being located between said web and the periphery of its associated roll, said baffle members being sufficiently long to shield the pond from translational energy from the roll surfaces which would otherwise be absorbed by the pond above said nip.

2. A size press assembly according to claim 1 in which:

one baffle member on each side of said web is in slightly spaced relation to a portion of the periphery of one of said rolls and terminates short of said nip.

3. A size press assembly according to claim 1 in which:

at least one baffle member on each side of said web is partly immersed in depending relation in said pond in spaced relation to the roll on said side, the lower end of each such baffle member terminating short of said nip and being in substantially parallel spaced relation with said web.

4. A size press assembly according to claim 1 in which:

a pair of said flexible baffle members is positioned between a roll and said web, one of each of the pairs of baffle members being in slightly spaced relation to a portion of the periphery of one roll and terminating short of said nip and the other of said pair of baffle members being immersed in depending relation in said pond and spaced relation to said roll, terminating short of said nip and being in parallel spaced relation with said web.

5. A size press assembly according to claim 1 which includes:

means for adjusting the vertical positioning of said flexible baffle members.

6. A size press assembly according to claim 1 in which:

said flexible baffle members are composed of rubber.

7. A size press assembly according to claim 1 in which:

said flexible baffle members are composed of polycarbonate resin.

8. A method for applying a sizing composition to a paper web which comprises:

passing said web into the nip between a pair of counter-rotating rolls, delivering a liquid sizing composition between the rolls and the web passing therebetween to thereby form a pond of sizing composition on each side of the traveling paper web, and immersing a flexible baffle element into each pond between said web and the roll which applies sizing composition to the side of said web facing said roll to a distance sufficient to reduce substantially the violent turbulence in said pond.

9. A method according to claim 8 in which:

said flexible baffle elements are bent into conformity with a portion of the peripheries of the associated rolls.

10. A method according to claim 9 in which additional flexible elements are immersed in said ponds between the roll peripheries and said traveling web.

* * * * *